US009246313B2

(12) United States Patent
Ban et al.

(10) Patent No.: US 9,246,313 B2
(45) Date of Patent: Jan. 26, 2016

(54) IGNITION SYSTEM

(71) Applicant: NGK SPARK PLUG CO., LTD., Nagoya (JP)

(72) Inventors: Kenji Ban, Gifu (JP); Tatsunori Yamada, Seto (JP); Tomokatsu Kashima, Kiyosu (JP); Katsutoshi Nakayama, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 133 days.

(21) Appl. No.: 14/087,412

(22) Filed: Nov. 22, 2013

(65) Prior Publication Data

US 2014/0145624 A1 May 29, 2014

(30) Foreign Application Priority Data

Nov. 29, 2012 (JP) ..... 2012-261245

(51) Int. Cl.

| | |
|---|---|
| ***H01T 15/00*** | (2006.01) |
| ***F02P 3/01*** | (2006.01) |
| ***F02P 3/04*** | (2006.01) |
| ***F02P 23/04*** | (2006.01) |

(52) U.S. Cl.

CPC . *H01T 15/00* (2013.01); *F02P 3/01* (2013.01); *F02P 3/04* (2013.01); *F02P 23/04* (2013.01)

(58) Field of Classification Search

CPC ..... H01T 15/00

USPC ..... 315/111.21, 172, 173; 361/253; 123/143 B, 644, 596

See application file for complete search history.

(56) References Cited

U.S. PATENT DOCUMENTS

| | | | | |
|---|---|---|---|---|
| 8,316,823 | B2 | 11/2012 | Sato et al. | |
| 8,528,531 | B2 * | 9/2013 | Nakano et al. | 123/596 |
| 2010/0132666 | A1 | 6/2010 | Sato et al. | |
| 2013/0234608 | A1 * | 9/2013 | Nakayama et al. | 315/173 |

FOREIGN PATENT DOCUMENTS

WO WO-2009/088045 A 7/2009

* cited by examiner

*Primary Examiner* — Daniel D Chang
(74) *Attorney, Agent, or Firm* — Leason Ellis LLP

(57) ABSTRACT

An ignition system includes an ignition plug, a discharge power supply for applying a high voltage to the gap of the ignition plug, a high-frequency power supply for supplying a high-frequency current to the gap, a matching unit provided between the ignition plug and the high-frequency power supply, and a mixer through which currents output from the two power supplies flow. An oscillation frequency fs (Hz) which maximizes the current flowing between the matching unit and the mixer when spark discharge is generated and an oscillation frequency fo (Hz) which maximizes the current flowing between the matching unit and the mixer when spark discharge is not generated satisfy a relation fs/fo≥0.85. Thus, a current whose oscillation frequency is equal to the oscillation frequency fs flows between the matching unit and the mixer when spark discharge is not generated.

10 Claims, 7 Drawing Sheets

IGNITION SYSTEM

This application claims the benefit of Japanese Patent Applications No. 2012-261245 filed on Nov. 29, 2012, which is incorporated by reference in its entirety herein.

FIELD OF THE INVENTION

The present invention relates to an ignition system for a plasma ignition plug which generates high-frequency plasma upon supply of high-frequency current thereto.

BACKGROUND OF THE INVENTION

An ignition plug used for an internal combustion engine or the like includes, for example, a center electrode extending in an axial direction, an insulator provided around the center electrode, a tubular metallic shell provided around the insulator, and a ground electrode whose proximal end portion is joined to a forward end portion of the metallic shell. Through application of a high voltage to the center electrode, spark discharge is generated at the gap formed between the center electrode and the ground electrode, whereby fuel gas is ignited.

In recent years, there has been proposed an ignition system which is configured to generate high-frequency plasma by supplying a high-frequency current to the spark discharge that is generated at the gap of an ignition plug through application of a high voltage thereto, to thereby enhance ignition performance (see, for example, International Publication No. PCT/JP2009/088045). Such an ignition system includes a discharge power supply for applying a high voltage to the gap, a high-frequency power supply for supplying a high-frequency current to the gap, and a mixer which is connected to the ignition plug through which output currents from the two power sources flow.

Problems to be Solved by the Invention

Also, a conceivable method of generating high-frequency plasma more reliably is as follows. A matching unit for establishing matching between the output impedance of the high-frequency power supply and the load impedance of a load (the ignition plug and the mixer) is provided between the high-frequency power supply and the mixer, and the matching unit and the high-frequency power supply (the oscillation frequency of high-frequency current) are set so as to maximize the current which flows between the matching unit and the mixer when the high-frequency current is output (namely, the current supplied to the gap). In general, the matching unit, etc. are set such that the current flowing between the matching unit and the mixer becomes maximum at the time when spark discharge is generated (hereinafter referred to as "spark discharge generation time").

However, in general, setting of the matching unit, etc. is performed without considering the times at which spark discharge is not generated (hereinafter referred to as "spark discharge absent time"). Therefore, as shown in FIG. 10, the oscillation frequency fs of the current flowing between the matching unit and the mixer which maximizes the current flowing between the matching unit and the mixer at the spark discharge generation time greatly differs from the oscillation frequency fo of the current flowing between the matching unit and the mixer which maximizes the current flowing between the matching unit and the mixer at the spark discharge absent time (in FIG. 10, a solid line shows a change in the current which flows between the matching unit and the mixer at the spark discharge generation time with the oscillation frequency of the current, and a broken line shows a change in the current which flows between the matching unit and the mixer at the spark discharge absent time with the oscillation frequency of the current). Accordingly, when spark discharge is generated, a sufficiently large current can be supplied to the gap, whereby high-frequency plasma can be generated. However, when no spark discharge is generated (for example, when spark discharge is blown out by fuel gas), current cannot be supplied to the gap, and high-frequency plasma cannot be generated. Namely, there is a possibility that the stability of supply of current to the gap cannot be secured to a sufficient degree, and high-frequency plasma cannot be generated stably.

In recent years, an internal combustion engine is configured to cause fuel gas to flow faster within each combustion chamber to thereby improve fuel consumption. In such an internal combustion engine, spark discharge is more likely to be blown out, and realization of excellent current supply stability is extremely difficult.

SUMMARY OF THE INVENTION

The present invention has been accomplished in view of the above-described circumstances, and its object is to provide an ignition system which can stably supply current to the gap of an ignition plug at both the spark discharge generation time and the spark discharge absent time, to thereby stably generate high-frequency plasma.

Means for Solving the Problems

Configurations suitable for achieving the above object will next be described in itemized form. If needed, actions and effects peculiar to the configurations will be described additionally.

Configuration 1. An ignition system of the present configuration comprises:

an ignition plug having a center electrode and a ground electrode;

a discharge power supply for applying a voltage to a gap formed between the center electrode and the ground electrode so as to generate spark discharge at the gap; and a high-frequency power supply for supplying a high-frequency current to the gap so as to generate high-frequency plasma at the gap, the ignition system being characterized by comprising:

a matching unit provided between the ignition plug and the high-frequency power supply; and a mixer which is electrically connected to the ignition plug and through which current output from the discharge power supply and current output from the high-frequency power supply flow, wherein when an oscillation frequency of a current which flows between the matching unit and the mixer when spark discharge is generated is represented by fs (Hz), a current whose oscillation frequency is equal to the oscillation frequency fs flows between the matching unit and the mixer when spark discharge is not generated.

Notably, the "matching unit" is a unit which establishes matching between the output impedance of the high-frequency power supply and the load impedance of a load (e.g., the ignition plug, etc.) to which high-frequency current is supplied. The oscillation frequency of the current flowing between the matching unit and the mixer can be changed by adjusting the matching unit.

According to the above-described configuration 1, the ignition system is configured such that when the oscillation frequency of a current which flows between the matching unit and the mixer when spark discharge is generated (spark discharge generation time) is represented by fs (Hz), a current whose oscillation frequency is equal to the oscillation frequency fs flows between the matching unit and the mixer when spark discharge is not generated (spark discharge absent time). Namely, current can be supplied to the gap not only at the spark discharge generation time but also at the spark discharge absent time. Accordingly, current can be stably supplied to the gap at both the spark discharge generation time and the spark discharge absent time, whereby high-frequency plasma can be generated stably.

The above-described configuration 1 can be realized by employing, for example, the following configuration 2.

Configuration 2. An ignition system of the present configuration comprises:

an ignition plug having a center electrode and a ground electrode;

a discharge power supply for applying a voltage to a gap formed between the center electrode and the ground electrode so as to generate spark discharge at the gap; and a high-frequency power supply for supplying a high-frequency current to the gap so as to generate high-frequency plasma at the gap, the ignition system being characterized by comprising:

a matching unit provided between the ignition plug and the high-frequency power supply; and a mixer which is electrically connected to the ignition plug and through which current output from the discharge power supply and current output from the high-frequency power supply flow, wherein the maximum value of current flowing between the matching unit and the mixer changes with an oscillation frequency of the current flowing between the matching unit and the mixer; and an oscillation frequency fs (Hz) which maximizes the current flowing between the matching unit and the mixer when spark discharge is generated and an oscillation frequency fo (Hz) which maximizes the current flowing between the matching unit and the mixer when spark discharge is not generated satisfy a relation $fs/fo \geq 0.85$.

Notably, oscillation frequencies (resonance points) which maximize the current flowing between the matching unit and the mixer; i.e., oscillation frequencies fs and fo, can be changed by adjusting the matching unit. Also, in general, fs is lower than fo (namely, a relation $1 \geq fs/fo$ is satisfied).

According to the above-described configuration 2, a relation $fs/fo \geq 0.85$ is satisfied, whereby the oscillation frequency fs which maximizes the current flowing between the matching unit and the mixer at the spark discharge generation time and the oscillation frequency fo which maximizes the current flowing between the matching unit and the mixer at the spark discharge absent time become very close to each other. Accordingly, by setting the matching unit and the high-frequency power supply such that the maximum current flows at the spark discharge generation time, it becomes possible to more reliably cause current to flow between the matching unit and the mixer in a sufficiently large amount at the spark discharge absent time (namely, it becomes possible to more reliably supply a sufficiently large current to the gap). As a result, current can be stably supplied to the gap at both the spark discharge generation time and the spark discharge absent time, whereby high-frequency plasma can be generated stably.

Configuration 3. An ignition system of the present configuration is characterized in that, in configuration 2 mentioned above, the oscillation frequencies fs and fo satisfy a relation $fs/fo \geq 0.90$.

According to the above-described configuration 3, the ignition system is configured such that the oscillation frequencies fs and fo become more closer to each other. Accordingly, a larger current can be caused to flow between the matching unit and the mixer at the spark discharge absent time, whereby current can be supplied to the gap more stably. As a result, high-frequency plasma can be generated more reliably.

Configuration 4. An ignition system of the present configuration is characterized in that, in any one of configurations 1 to 3 mentioned above, the matching unit includes a capacitor and an inductor, and the inductor is an air-cored coil.

According to the above-described configuration 4, the loss of electric power produced when current is supplied from the high-frequency power supply to the ignition plug (the gap) can be decreased. Accordingly, the stability of supply of current to the gap can be enhanced further.

Notably, in the case where the matching unit includes a plurality of inductors, it is sufficient that at least one of the inductors is an air-cored coil.

Configuration 5. An ignition system of the present configuration is characterized in that, in any one of configurations 1 to 4 mentioned above, the oscillation frequency fs is not lower than 1 MHz and not higher than 5 MHz.

According to the above-described configuration 5, the ignition system is configured such that the oscillation frequency fs is not lower than 1 MHz. Accordingly, it is possible to more reliably prevent lowering of current transmission efficiency, which lowering would otherwise occur when current is supplied from the high-frequency power supply to the ignition plug through the matching unit. As a result, current can be supplied to the gap more stably.

According to the above-described configuration 5, the ignition system is configured such that the oscillation frequency fs is not higher than 5 MHz. Accordingly, it is possible to prevent the resistance component of the matching unit from increasing excessively, to thereby more reliably prevent decrease of the current supplied to the gap. Thus, the stability of supply of current to the gap can be enhanced further.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

[Modes for Carrying out the Invention]

Figure 1:
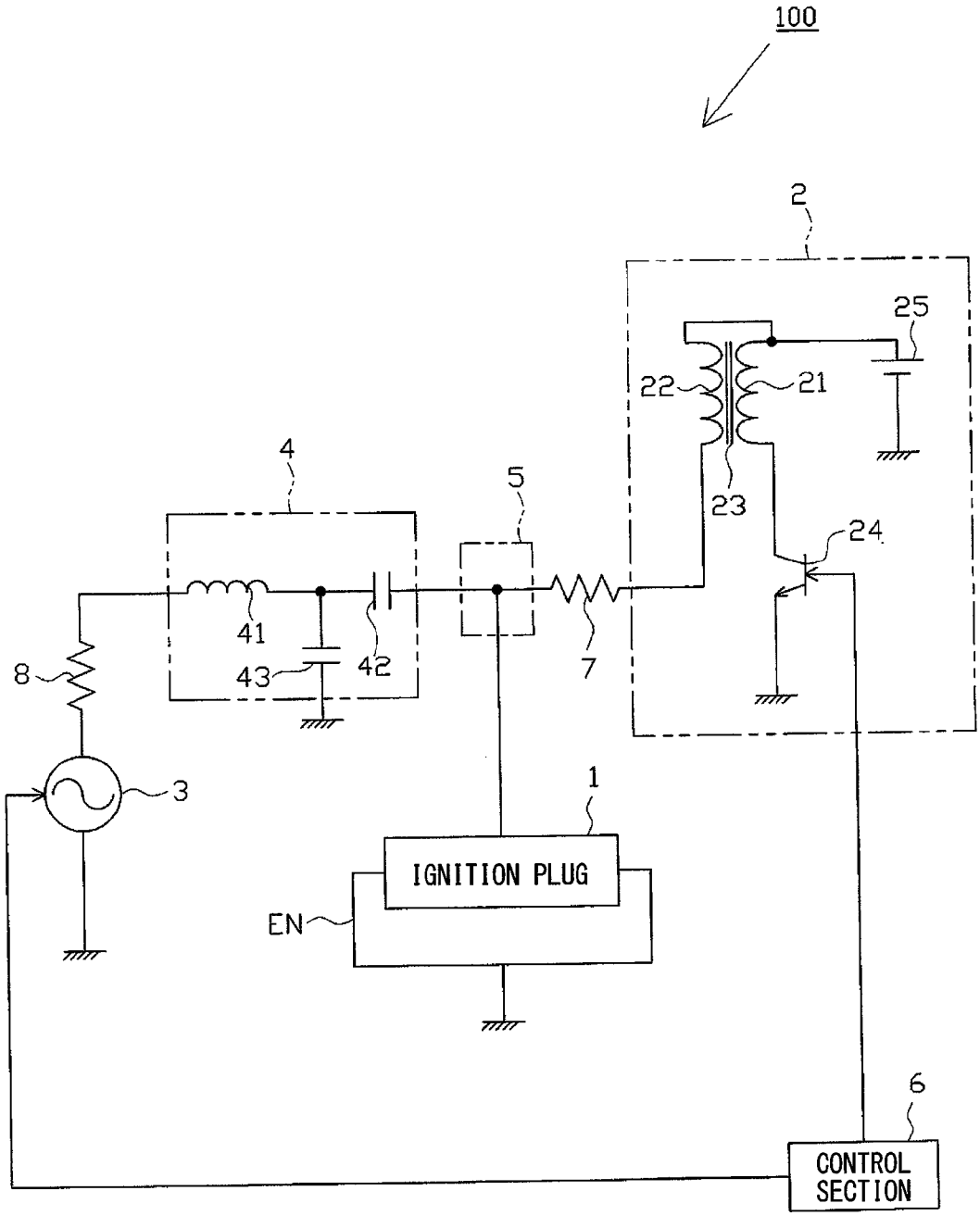
FIG. 1 is a block diagram schematically showing the configuration of an ignition system.

An embodiment will next be described with reference to the drawings. FIG. 1 is a block diagram schematically showing the configuration of an ignition system 100 which includes an ignition plug 1, a discharge power supply 2, a high-frequency power supply 3, a matching unit 4, a mixer 5, and a control section 6. Although FIG. 1 shows a single ignition plug 1, an actual internal combustion engine EN has a plurality of cylinders, and the ignition plug 1 is provided for each of the cylinders. Electric power from the discharge power supply 2 and that from the high-frequency power supply 3 are supplied to the ignition plugs 1 through a distributer (not shown). Notably, the discharge power supply 2 and the high-frequency power supply 3 may be provided for each ignition plug 1 individually. The internal combustion engine EN in the present embodiment is configured such that fuel gas flows within each combustion chamber at relatively high speed so as to improve fuel consumption performance, etc. Therefore, spark may be blown away to a great extent.

Figure 2:
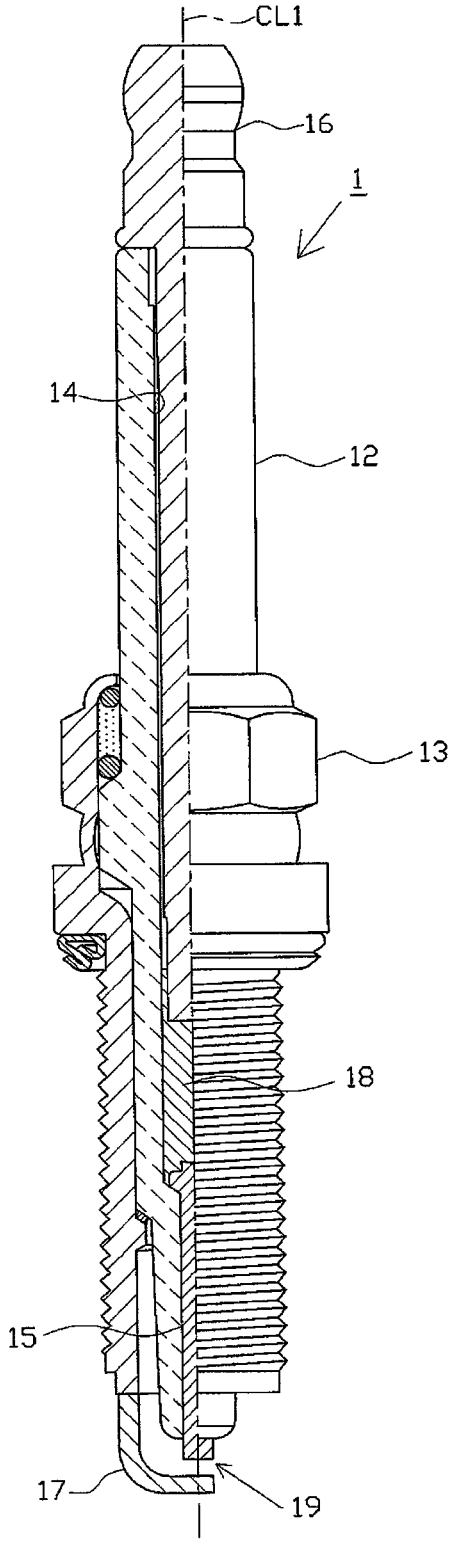
FIG. 2 is a partially sectioned front view of an ignition plug.

As shown in FIG. 2, the ignition plug 1 includes a tubular ceramic insulator 12 having an axial hole 14 extending in the direction of an axis CL1; a center electrode 15 and a terminal electrode 16 which are inserted into the axial hole 14; a tubular metallic shell 13 disposed around the ceramic insulator 12; and a ground electrode 17 fixed to a forward end portion of the metallic shell 13. The center electrode 15 and the terminal electrode 16 are fixed to the ceramic insulator 12 by an electrically conductive glass seal layer 18, and are electrically connected together through the glass seal layer 18. A gap 19 is formed between a forward end portion of the center electrode 15 and a distal end portion of the ground electrode 17.

Referring back to FIG. 1, the discharge power supply 2 applies a high voltage to the ignition plug 1 so as to generate spark discharge at the gap 19 of the ignition plug 1. In the present embodiment, the discharge power supply 2 includes a primary coil 21, a secondary coil 22, a core 23, an igniter 24, and a battery 25 for power supply.

The primary coil 21 is wound around the core 23. One end of the primary coil 21 is connected to the battery 25, and the other end thereof is connected to the igniter 24. The secondary coil 22 is wound around the core 23. One end of the secondary coil 22 is connected to a line between the primary coil 21 and the battery 25, and the other end thereof is connected to the ignition plug 1 through the mixer 5 and a predetermined resistor 7.

In accordance with an energization signal input from the control section 6, the igniter 24, which is formed by a predetermined transistor, selectively establishes, through switching, a state in which electric power is supplied from the battery 25 to the primary coil 21 or a state in which the supply of electric power is stopped. When a high voltage is to be applied to the ignition plug 1, current is supplied from the battery 25 to the primary coil 21 to thereby form a magnetic field around the core 23, and in this state, the energization signal from the control section 6 is switched from an ON level to an OFF level so as to stop the supply of electricity from the battery 25 to the primary coil 21. As a result of stoppage of the electricity supply, the magnetic field of the core 23 changes, and the secondary coil 22 generates a high voltage (e.g., 5 kV to 30 kV) of negative polarity. This high voltage is applied to the ignition plug 1 (the gap 19), whereby spark discharge is generated at the gap 19.

The high-frequency power supply 3 is connected to the ignition plug 1 via the matching unit 4, the mixer 5, and a predetermined resistor 8. The high-frequency power supply 3 supplies to the ignition plug 1 current (alternating current in the present embodiment) whose frequency is relatively high (e.g., not lower than 1 MHz and not higher than 15 MHz). In the present embodiment, the high-frequency power supply 3 outputs current having a fixed frequency. The transmission path for transmitting the high-frequency current from the high-frequency power supply 3 to the ignition plug 1 is formed by a coaxial cable having an inner conductor, and an outer conductor disposed around the inner conductor. As a result, reflection of electric power is prevented.

The matching unit 4 is provided between the high-frequency power supply 3 and the mixer 5, and is formed by an LC resonance circuit having an inductor 41 and capacitors 42 and 43. The inductor 41 and the capacitor 42 are connected in series between the high-frequency power supply 3 and the mixer 5, and the capacitor 43 is connected in parallel to the inductor 41 and the capacitor 42. In the present embodiment, the output impedance of the power supply side (the side toward the high-frequency power supply 3) and the input impedance of the load side (the side toward the mixer 5 and the ignition plug 1) can be matched each other by adjusting the inductance of the inductor 41 and the capacitances of the capacitors 42 and 43.

In the present embodiment, the secondary coil 22 of the discharge power supply 2 prevents the current output from the high-frequency power supply 3 and having a relatively high frequency from flowing toward the battery 25. Meanwhile, the inductor 41 and the capacitor 42 of the matching unit 4 prevent the current output from the discharge power supply 2 and having a relatively low frequency from flowing toward the high-frequency power supply 3. A diode may be provided between the high-frequency power supply 3 and the mixer 5 in order to prevent the current output from the discharge power supply 2 from flowing into the high-frequency power supply 3.

The mixer 5 merges a transmission path for the high voltage output from the discharge power supply 2 and a transmission path for the high-frequency current output from the high-frequency power supply 3 into a single transmission path connected to the ignition plug 1. Both the current output from the discharge power supply 2 and that output from the high-frequency power supply 3 flow through the mixer 5 and reach the ignition plug 1.

The control section 6, which is formed by a predetermined electronic control unit (ECU), controls, among others, the timings at which electric power from the discharge power supply 2 and that from the high-frequency power supply 3 are supplied to the ignition plug 1. In the present embodiment, in a state in which spark discharge is generated through application of a high voltage from the discharge power supply 2 to the gap 19 of the ignition plug 1, a high-frequency current is supplied from the high-frequency power supply 3 to the ignition plug 1 (the gap 19), whereby high-frequency plasma is generated at the gap 19.

Incidentally, although the ignition system 100 is configured to generate high-frequency plasma by supplying high-frequency electric power after generation of spark discharge, in the present embodiment, the spark discharge is likely to be blown out by fuel gas, because, as described above, the flow speed of the fuel gas within each combustion chamber of the internal combustion engine EN is relatively high. Accordingly, there often arises a situation where the high-frequency current is supplied to the gap 19 in a state in which spark discharge is not generated.

Figure 3:
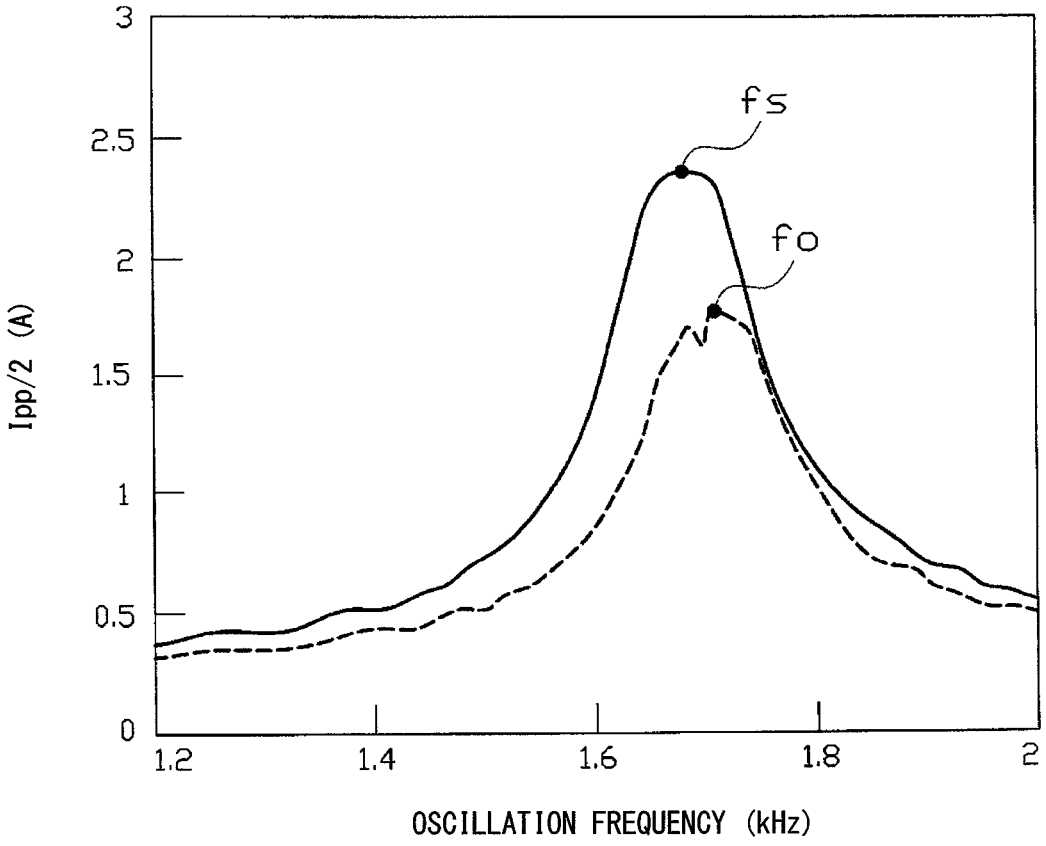
FIG. 3 is a graph showing a change in current flowing between a matching unit and a mixer at the spark discharge generation time with the oscillation frequency of the current, and a change in the current flowing between the matching unit and the mixer at the spark discharge absent time with the oscillation frequency of the current.

In view of this, in the present embodiment, the inductance of the inductor 41 and the capacitances of the capacitors 42 and 43 of the matching unit 4 are adjusted such that an oscillation frequency fs (Hz) which maximizes the current which flows between the matching unit 4 and the mixer 5 at the spark discharge generation time and an oscillation frequency fo (Hz) which maximizes the current which flows between the matching unit 4 and the mixer 5 at the spark discharge absent time satisfy a relation $fs/fo \geq 0.85$ (more preferably, $fs/fo \geq 0.90$). Namely, the present ignition system is configured such that the oscillation frequency fs and the oscillation frequency fo are very close to each other as shown in FIG. 3. In FIG. 3, a solid line shows a change in the current flowing between the matching unit 4 and the mixer 5 at the spark discharge generation time with the oscillation frequency of the current flowing between the matching unit 4 and the mixer 5, and a broken line shows a change in the current flowing between the matching unit 4 and the mixer 5 at the spark discharge absent time with the oscillation frequency of the current flowing between the matching unit 4 and the mixer 5.

The high-frequency power supply 3 outputs high-frequency current determined such that the oscillation frequency of the current flowing between the matching unit 4 and the mixer 5 becomes equal to the oscillation frequency fs (Hz). Therefore, it becomes possible to maximize the current flowing between the matching unit 4 and the mixer 5 at the spark discharge generation time. Thus, high-frequency plasma can be generated stably at the spark discharge generation time.

Also, since the relation $fs/fo \geq 0.85$ is satisfied, even at the spark discharge absent time (e.g., the case where spark discharge is blown out), a sufficiently large current can be caused to flow between the matching unit 4 and the mixer 5 (a sufficiently large current can be supplied to the gap 19). Thus, high-frequency plasma can be generated stably even at the spark discharge absent time. Namely, in the present embodiment, current can be caused to flow between the matching unit 4 and the mixer 5 (current can be supplied to the gap 19) at both the spark discharge generation time and the spark discharge absent time. Therefore, in the ignition system 100, when the oscillation frequency of the current flowing between the matching unit 4 and the mixer 5 at the spark discharge generation time is represented by fs (Hz), a current whose oscillation frequency is equal to fs flows between the matching unit 4 and the mixer 5 at the spark discharge absent time as well.

In addition, in the present embodiment, the inductor 41 of the matching unit 4 is an air-cored coil which is formed by spirally winding a predetermined electrically conductive metal wire without disposing a core formed of iron or the like inside the coil.

Further, in the present embodiment, the oscillation frequency of the current output from the high-frequency power supply 3, the inductance of the inductor 41 of the matching unit 4, etc. are set such that the above-mentioned oscillation frequency fs falls within a range of 1 MHz to 5 MHz (i.e., not lower than 1 MHz and not higher than 5 MHz).

As having been described in detail, according to the present embodiment, the ignition system 100 is configured such that the relation $fs/fo \geq 0.85$ is satisfied; whereby the oscillation frequency fs which maximizes the current flowing between the matching unit 4 and the mixer 5 at the spark discharge generation time and the oscillation frequency fo which maximizes the current flowing between the matching unit 4 and the mixer 5 at the spark discharge absent time become very close to each other. Accordingly, by setting the matching unit 4 and the high-frequency power supply 3 such that the maximum current flows at the spark discharge generation time, it becomes possible to more reliably cause current to flow between the matching unit 4 and the mixer 5 in a sufficiently large amount (namely, it becomes possible to more reliably supply a sufficiently large current to the gap 19) even at the spark discharge absent time. As a result, current can be stably supplied to the gap 19 at both the spark discharge generation time and the spark discharge absent time, whereby high-frequency plasma can be generated stably.

In particular, in the present embodiment, it is very difficult to secure excellent current supply stability because the flow of fuel gas is relatively fast. However, the above-described configuration can realize excellent current supply stability even when the flow of fuel gas is fast. In other words, the ignition system 100 is particularly effective when it is used for an internal combustion engine in which the flow of fuel gas is relatively fast and spark may be blown away to a great extent.

In the present embodiment, since the inductor 41 is an air-cored coil, the loss of electric power produced when current is supplied from the high-frequency power supply 3 to the ignition plug 1 (the gap 19) can be reduced. Accordingly, the stability of supply of current to the gap 19 can be enhanced further.

Since the oscillation frequency fs is not lower than 1 MHz, it is possible to more reliably prevent lowering of current transmission efficiency, which lowering would otherwise occur when current is supplied from the high-frequency power supply 3 to the ignition plug 1 through the matching unit 4. As a result, current can be supplied to the gap 19 more stably.

Since the oscillation frequency fs is not higher than 5 MHz, it is possible to prevent the resistance component of the matching unit from increasing excessively, to thereby more reliably prevent decrease of the current supplied to the gap 19. Thus, the stability of supply of current to the gap 19 can be enhanced further.

In order to confirm the action and effect achieved by the above-described embodiment, samples of the ignition system were made and a supply rate evaluation test was performed for the samples. The samples differ from one another in the ratio (fs/fo) of the oscillation frequency fs (Hz) which maximizes the current flowing between the matching unit and the mixer at the spark discharge generation time to the oscillation frequency fo (Hz) which maximizes the current flowing between the matching unit and the mixer at the spark discharge absent time (the ratio will be referred to as the "frequency ratio").

The outline of the supply rate evaluation test is as follows. Namely, an ignition plug was attached to a predetermined chamber, and valves at the inlet and outlet of the chamber were adjusted so as to fill the chamber with air of 1 MPa. Under the conditions under which a flow field is formed such that a flow having a certain velocity is produced at the gap of the ignition plug (that is, the conditions under which spark discharge is likely to be blown out), an operation of applying high voltage to the gap and supplying high-frequency current to the gap was performed 100 times. The ratio of the number of times the high-frequency current was stably supplied to the gap (supply success rate) was obtained. The term "stably" refers to a state in which substantially the same maximum current flows through the gap in each period of the high-frequency current, and the variation of the current flowing through the gap is small.

Figure 4:
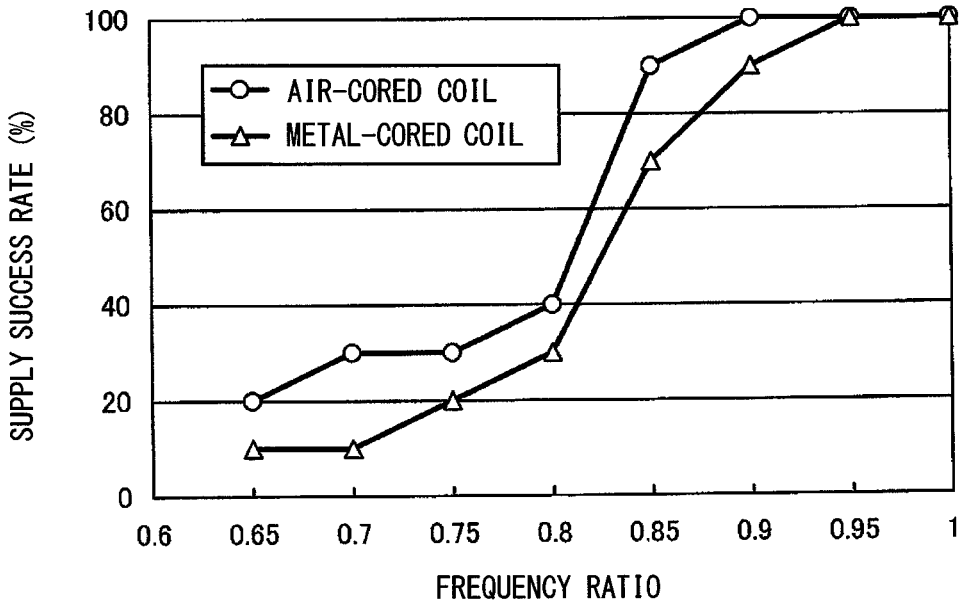
FIG. 4 is a graph showing the relation between frequency ratio and supply success rate.

FIG. 4 is a graph showing the relation between frequency ratio and supply success rate. Notably, in some samples, an air-cored coil having no metal core (that is, a core having a hollow center) was used as the inductor of the matching unit, and in the remaining samples, a metal-cored coil having a metal core was used as the inductor of the matching unit. In FIG. 4, the test results of the samples including the air-cored coil are indicated by circular marks, and the test results of the samples including the metal-cored coil are indicated by triangular marks. In this test, the samples were configured such that the oscillation frequency fs became about 1.7 MHz.

FIG. 4 reveals that, as compared with the samples whose frequency ratios (fs/fo) are less than 0.85, the samples whose frequency ratios ((fs/fo) are equal to or greater than 0.85 have remarkably increased supply success rates and can supply current to the gap stably even under the conditions under which spark discharge is likely to be blown out.

In particular, it was found that the samples whose frequency ratios (fs/fo) are equal to or greater than 0.90 have further increased supply success rates and can supply current to the gap more stably.

Also, it was confirmed that the samples in which an air-cored coil is used as the inductor of the matching unit have further improved stability in terms of supply of electricity to the gap. Conceivably, this is because the loss of electric power produced when current is supplied from the high-frequency power supply to the ignition plug (the gap) is decreased as a result of use of an air-cored coil.

The results of the above-described test show that the ignition system is preferably configured such that the oscillation frequency fs (Hz) which maximizes the current flowing between the matching unit and the mixer at the spark discharge generation time and the oscillation frequency fo (Hz) which maximizes the current flowing between the matching unit and the mixer at the spark discharge absent time satisfy the relation $fs/fo \geq 0.85$ in order to improve the stability of supply of current to the gap and stably generate high-frequency plasma at both the spark discharge generation time and the spark discharge absent time.

From the viewpoint of further enhancing the current supply stability, it is more preferred that the ignition system be configured to satisfy the relation $fs/fo \geq 0.90$ or to use an air-cored coil as the inductor of the matching unit.

Next, samples of the ignition system which differed from one another in the oscillation frequency fs and the frequency ratio (fs/fo) were made, and the above-described supply rate evaluation test was performed for the samples.

Figure 5:
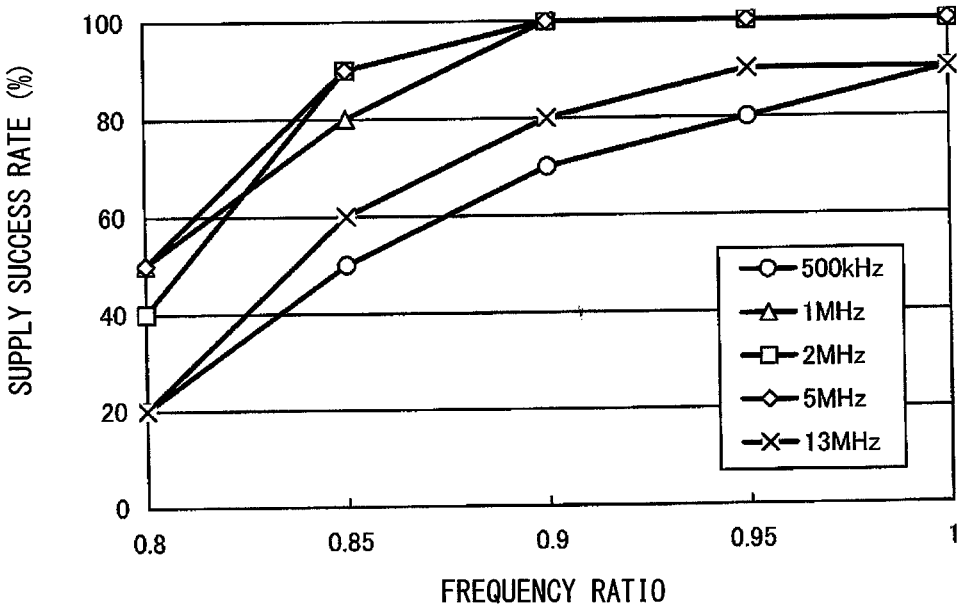
FIG. 5 is a graph showing the supply success rate when the oscillation frequency fs is changed.

FIG. 5 shows the results of the test. In FIG. 5, the test results of the samples whose oscillation frequencies fs were set to 500 kHz are indicated by circular marks, and the test results of the samples whose oscillation frequencies fs were set to 1 MHz are indicated by triangular marks. Also, the test results of the samples whose oscillation frequencies fs were set to 2 MHz are indicated by square marks, and the test results of the samples whose oscillation frequencies fs were set to 5 MHz are indicated by rhombic marks. Further, the test results of the samples whose oscillation frequencies fs were set to 13 MHz are indicated by cruciform marks.

It was found that, as shown in FIG. 5, the samples whose frequency ratios (fs/fo) are 0.85 or greater are excellent in terms of current supply stability, and, of these samples, the samples whose frequencies fs fall within the range of 1 MHz to 5 MHz are particularly excellent in terms of current supply stability. Considerably, this is because as a result of setting the oscillation frequency fs to fall within the range of 1 MHz to 5 MHz, the loss of electric power in the matching unit at the time of transmission of current is decreased effectively.

The results of the above-described test show that the oscillation frequency fs is preferably set to fall within the range of 1 MHz to 5 MHz in order to further enhance the stability of supply of current to the gap.

The present invention is not limited to the above-described embodiment, but may be embodied, for example, as follows. Of course, applications and modifications other than those exemplified below are also possible.

(a) The circuit configuration of the matching unit 4 in the above-described embodiment is a mere example, and the matching unit may be modified freely in accordance with, for example, the configuration of the ignition plug 1 (e.g., the electrostatic capacitance, etc. of the ignition plug 1).

Figure 6:
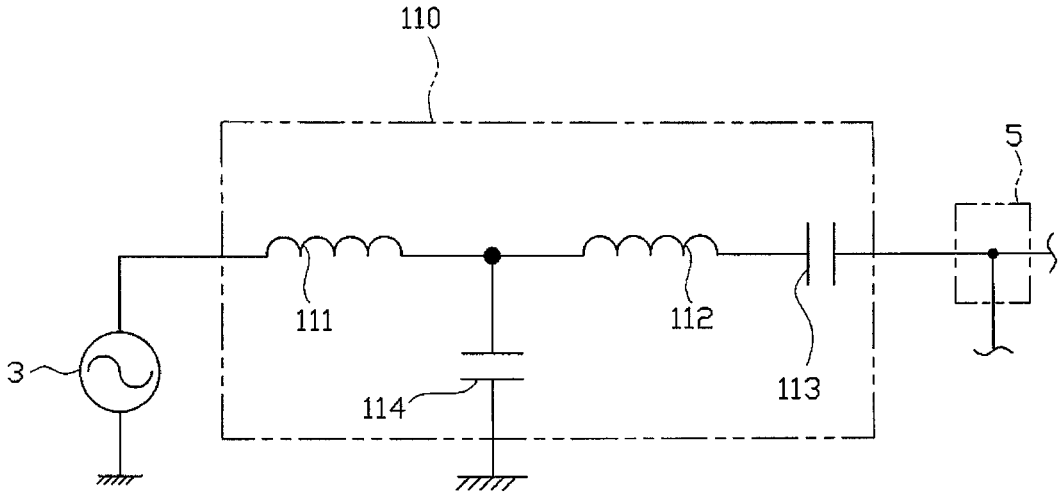
FIG. 6 is a block diagram showing the configuration of a matching unit according to another embodiment.

Accordingly, a matching unit 110 shown in FIG. 6 may be used. The matching unit 110 includes inductors 111 and 112 and a capacitor 113 which are connected in series between the high-frequency power supply 3 and the mixer 5, and a capacitor 114 which is connected to a line between the inductors 111 and 112 to be parallel to the inductor 111, etc.

Figure 7:
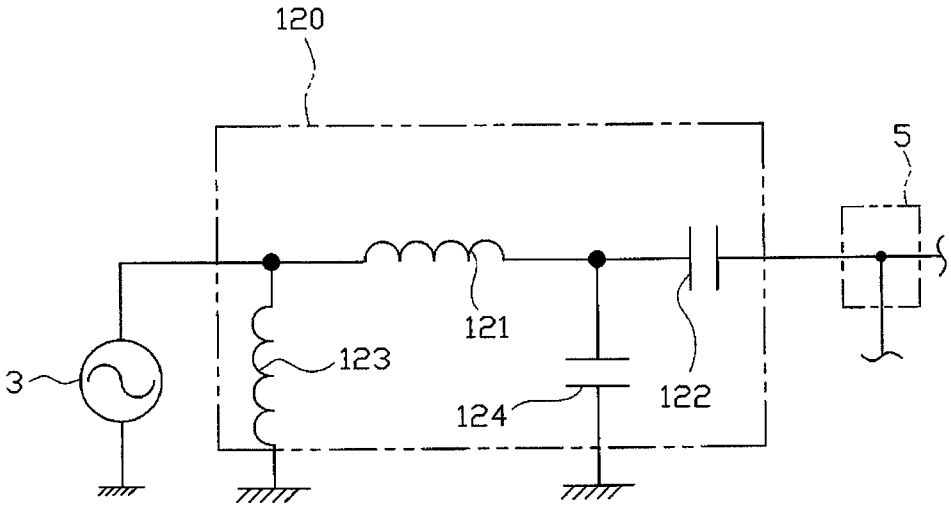
FIG. 7 is a block diagram showing the configuration of a matching unit according to still another embodiment.

Alternatively, a matching unit 120 shown in FIG. 7 may be used. The matching unit 120 includes an inductor 121 and a capacitor 122 which are connected in series between the high-frequency power supply 3 and the mixer 5, an inductor 123 which is connected to a line between the high-frequency power supply 3 and the inductor 121 to be parallel to the inductor 121, etc., and a capacitor 124 which is connected to a line between the inductor 121 and the capacitor 122 to be parallel to the inductor 121, etc.

Figure 8:
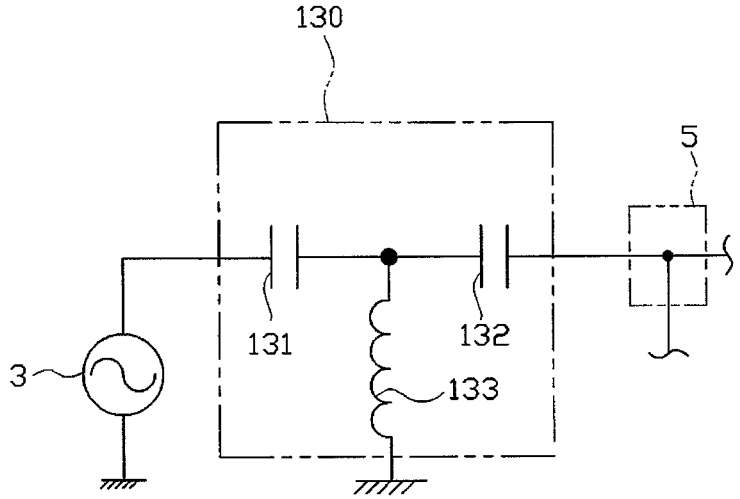
FIG. 8 is a block diagram showing the configuration of a matching unit according to still another embodiment.

Alternatively, a matching unit 130 shown in FIG. 8 may be used. The matching unit 130 includes capacitors 131 and 132 which are connected in series between the high-frequency power supply 3 and the mixer 5, and an inductor 133 which is connected to a line between the capacitors 131 and 132 to be parallel to the capacitor 131, etc.

Figure 9:
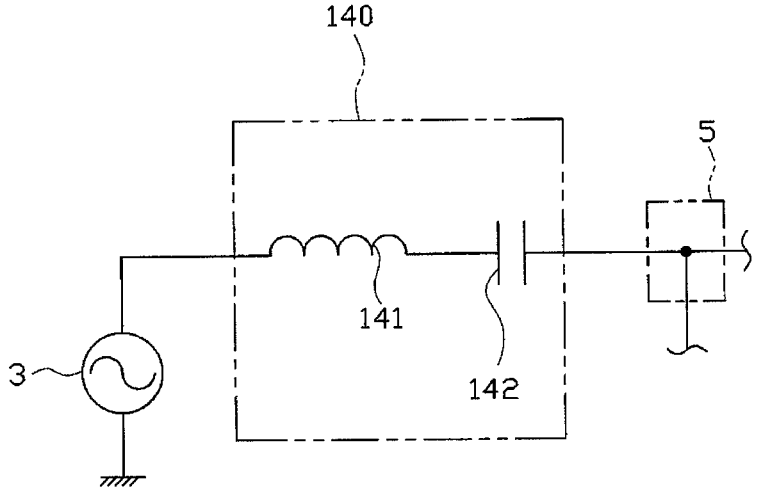
FIG. 9 is a block diagram showing the configuration of a matching unit according to still another embodiment.
Figure 10:
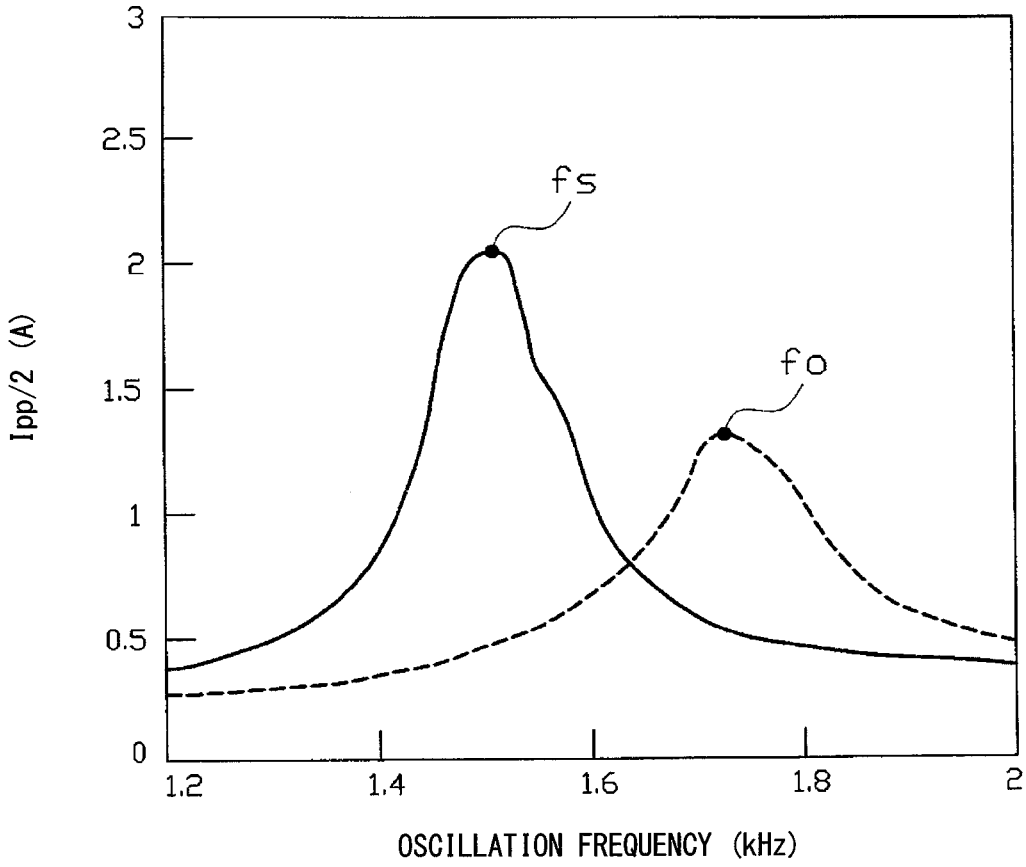
FIG. 10 is a graph exemplifying an oscillation frequency fs which maximizes the current flowing between a matching unit and a mixer at the spark discharge generation time and an oscillation frequency fo which maximizes the current flowing between the matching unit and the mixer at the spark discharge absent time in a conventional ignition system.

Alternatively, a matching unit 140 shown in FIG. 9 may be used. The matching unit 140 includes an inductor 141 and a capacitor 142 which are connected in series between the high-frequency power supply 3 and the mixer 5.

(b) The structure of the ignition plug 1 in the above-described embodiment is a mere example, and the structure of the ignition plug to which the technical idea of the present invention can be applied is not limited thereto. Accordingly, technical idea of the present invention may be applied to a plasma jet ignition plug in which a forward end portion of the center electrode is located rearward of the forward end of the ceramic insulator and which has a space (cavity) defined by the forward end surface of the center electrode and the wall surface of the axial hole.

(c) In the above-described embodiment, the inductor 41 of the matching unit 4 is an air-cored coil. However, a metal-cored coil having a metal core may be used. In the case where the matching unit includes a plurality of inductors, both the air-cored coil and the metal-cored coil may be used.

(d) The ignition system 100 in the above-described embodiment is configured such that the high-frequency power supply 3 outputs current having a fixed frequency. However, a device for changing the frequency of the output current may be provided so as to adjust the frequency of the current output from the high-frequency power supply 3.

[Description Of Reference Numerals]

1: ignition plug, 2: discharge power supply, 3: high-frequency power supply, 4: matching unit, 5: mixer, 15: center electrode, 17: ground electrode, 19: gap, 41: inductor, 42, 43: capacitor, 100: ignition system.

The invention claimed is:

1. An ignition system comprising:

an ignition plug having a center electrode and a ground electrode;

a discharge power supply for applying a voltage to a gap formed between the center electrode and the ground electrode so as to generate spark discharge at the gap;

a high-frequency power supply for supplying a high-frequency current to the gap so as to generate high-frequency plasma at the gap;

a matching unit provided between the ignition plug and the high-frequency power supply; and a mixer which is electrically connected to the ignition plug and through which current output from the discharge power supply and current output from the high-frequency power supply flow, wherein when an oscillation frequency of a current which flows between the matching unit and the mixer when spark discharge is generated is represented by fs (Hz), a current whose oscillation frequency is equal to the oscillation frequency fs flows between the matching unit and the mixer when spark discharge is not generated.

2. An ignition system comprising:

an ignition plug having a center electrode and a ground electrode;

a discharge power supply for applying a voltage to a gap formed between the center electrode and the ground electrode so as to generate spark discharge at the gap;

a high-frequency power supply for supplying a high-frequency current to the gap so as to generate high-frequency plasma at the gap;

a matching unit provided between the ignition plug and the high-frequency power supply; and a mixer which is electrically connected to the ignition plug and through which current output from the discharge power supply and current output from the high-frequency power supply flow, wherein a maximum value of current flowing between the matching unit and the mixer changes with an oscillation frequency of the current flowing between the matching unit and the mixer; and an oscillation frequency fs (Hz) maximizes the current flowing between the matching unit and the mixer when spark discharge is generated, an oscillation frequency fo (Hz) maximizes the current flowing between the matching unit and the mixer when spark discharge is not generated, and the oscillation frequencies fs and fo satisfy a relation $fs/fo \geq 0.85$.

3. The ignition system according to claim 2, wherein the oscillation frequencies fs and fo satisfy a relation $fs/fo \geq 0.90$.

4. The ignition system according to claim 1, wherein the matching unit includes a capacitor and an inductor, said inductor being an air-cored coil.

5. The ignition system according to claim 1, wherein the oscillation frequency fs is not lower than 1 MHz and not higher than 5 MHz.

6. The ignition system according to claim 2, wherein the matching unit includes a capacitor and an inductor, said inductor being an air-cored coil.

7. The ignition system according to claim 3, wherein the matching unit includes a capacitor and an inductor, said inductor being an air-cored coil.

8. The ignition system according to claim 2, wherein the oscillation frequency fs is not lower than 1 MHz and not higher than 5 MHz.

9. The ignition system according to claim 3, wherein the oscillation frequency fs is not lower than 1 MHz and not higher than 5 MHz.

10. The ignition system according to claim 4, wherein the oscillation frequency fs is not lower than 1 MHz and not higher than 5 MHz.

* * * * *